US009085969B2

(12) United States Patent
Clay et al.

(10) Patent No.: US 9,085,969 B2
(45) Date of Patent: Jul. 21, 2015

(54) BI-DIRECTIONAL SHAPED CHARGES FOR PERFORATING A WELLBORE

(71) Applicant: OWEN OIL TOOLS LP, Houston, TX (US)

(72) Inventors: Matthew M. Clay, Fort Worth, TX (US); Shaun M. Geerts, Houston, TX (US); Daniel W. Pratt, Benbrook, TX (US); Thomas C. Montanez, Houston, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 0 days.

(21) Appl. No.: 14/072,372

(22) Filed: Nov. 5, 2013

(65) Prior Publication Data

US 2014/0123841 A1 May 8, 2014

Related U.S. Application Data

(60) Provisional application No. 61/722,463, filed on Nov. 5, 2012, provisional application No. 61/739,316, filed on Dec. 19, 2012.

(51) Int. Cl.
*B64D 1/04* (2006.01)
*E21B 43/117* (2006.01)

(52) U.S. Cl.
CPC ..... *E21B 43/117* (2013.01)

(58) Field of Classification Search
USPC ..... 89/1.15, 1.151; 102/306, 308, 310, 320; 175/4.6; 166/361, 55, 55.2
See application file for complete search history.

(56) References Cited

U.S. PATENT DOCUMENTS

| | | | |
|---|---|---|---|
| 3,013,491 | A | 12/1961 | Poulter |
| 5,033,553 | A | 7/1991 | Miszewski et al. |
| 5,603,379 | A | 2/1997 | Henke et al. |
| 5,709,265 | A | 1/1998 | Haugen et al. |
| 6,003,599 | A | 12/1999 | Huber et al. |
| 6,354,219 | B1 | 3/2002 | Pratt et al. |
| 6,536,524 | B1 | 3/2003 | Snider |
| 6,595,290 | B2 | 7/2003 | George et al. |
| 6,684,954 | B2 | 2/2004 | George |
| 8,622,132 | B2 | 1/2014 | Mytopher et al. |
| 2004/0134658 | A1 | 7/2004 | Bell et al. |
| 2011/0017453 | A1 | 1/2011 | Mytopher et al. |

OTHER PUBLICATIONS

PCT/US2013/068514—International Search Report and Written Opinion dated Jul. 28, 2014.

*Primary Examiner* — J. Woodrow Eldred
(74) *Attorney, Agent, or Firm* — Mossman, Kumar & Tyler, PC

(57) ABSTRACT

A shaped charge assembly for perforating a wellbore tubular and a subterranean formation intersected by a wellbore may include a first shaped charge and a second shaped charge disposed on an outer surface of the wellbore tubular. The first shaped charge points radially outward toward the formation, and the second shaped charge points radially inward toward the wellbore tubular.

8 Claims, 2 Drawing Sheets

BI-DIRECTIONAL SHAPED CHARGES FOR PERFORATING A WELLBORE

CROSS REFERENCE TO RELATED APPLICATIONS

This application claims priority from U.S. Provisional Application Ser. No. 61/722,463, filed Nov. 5, 2012 and from U.S. Provisional Application Ser. No. 61/739,316, filed Dec. 19, 2012, the disclosures of which are incorporated herein by reference.

BACKGROUND OF THE DISCLOSURE

1. Field of the Disclosure

The present disclosure relates to bidirectional shaped charges for perforating a formation.

2. Description of the Related Art

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun loaded with shaped charges. The gun is lowered into the wellbore on electric wireline, slickline, tubing, coiled tubing, or other conveyance device until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

In certain situations, the wellbore tubulars used in a well may be difficult to perforate using conventional devices. In aspects, the present disclosure provides shaped charges for such situations.

SUMMARY OF THE DISCLOSURE

In aspects, the present disclosure provide a shaped charge assembly for perforating a wellbore tubular and a subterranean formation intersected by a wellbore. The shaped charge assembly may include a first shaped charge and a second shaped charge disposed on an outer surface of the wellbore tubular. The first shaped charge points radially outward toward the formation, and the second shaped charge points radially inward toward the wellbore tubular.

It should be understood that examples of certain features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the exemplary embodiment, taken in conjunction with the accompanying drawings, in which like elements have been given like numerals and wherein.

DESCRIPTION OF THE DISCLOSURE

Figure 1:
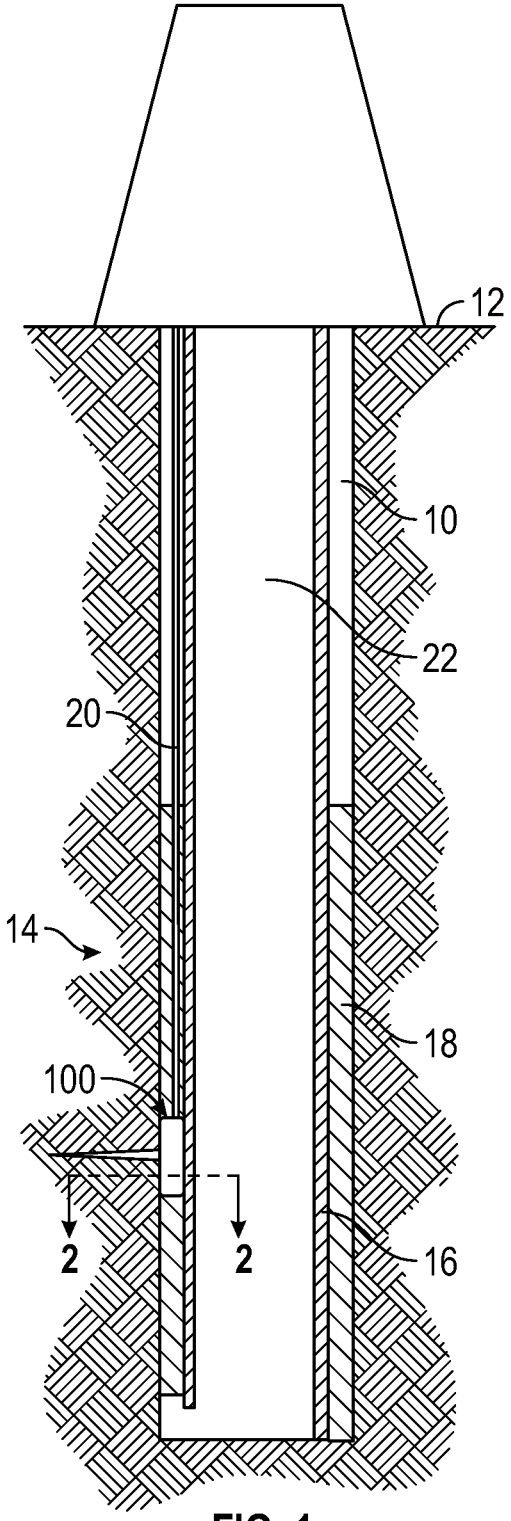
FIG. 1 illustrates one embodiment of a shaped charge assembly in accordance with the present disclosure positioned in a wellbore.

The present disclosure relates to bi-directional shaped charges for perforating a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

In accordance with the present disclosure, a bi-directional shaped charge assembly may be configured to be conveyed via casing into a subterranean well bore and positioned adjacent the exterior of the casing; i.e., in the annular space between the casing and a wall of the wellbore. The shaped charge assembly includes at least two shaped charges. The shaped charge assembly includes at least one shaped charge that punctures the casing, and at least one shaped charge that perforates the adjacent formation. Because these shaped charges are oriented in opposing directions, this arrangement may be referred to as "bi-directional."

Referring to FIG. 1, a subterranean well bore 10 is illustrated as extending from the surface of the earth or sea floor 12 and penetrating at least one subterranean formation 14. A casing 16 may be installed in the well bore 10 and secured in the wellbore 10 with cement 18. The term "casing" refers to wellbore tubular, which may be metal casing, liner, production tubing, drill string, that are used in a well bore to seal off fluids from the well bore and to stabilize the walls of the well bore. The shaped charge assembly of the present disclosure is illustrated generally as 100 in FIG. 1. As shown, the shaped charge assembly 100 may be secured to the exterior of the casing 16 adjacent the outer surface. Any suitable means, for example by metal bands, such as stainless steel bands, may be used to fix the shaped charge assembly 100 to the casing 16.

As illustrated in FIG. 1, a control system 20, for example an electric line, extends from a suitable power source (not illustrated) at the surface 12 to the shaped charge assembly 100 to provide an appropriate signal to ignite the shaped charge assembly 100. Other suitable control systems for igniting the explosive charge(s) contained in shaped charge assembly 100, such as hydraulic lines connected to a suitable source of pressurized hydraulic fluid (liquid or gas) or electromagnetic or acoustic signaling and corresponding receivers connected to the shaped charge assemblies for wave transmissions through the casing, soil and/or well bore fluids, may also be employed in the present disclosure.

Figure 2:
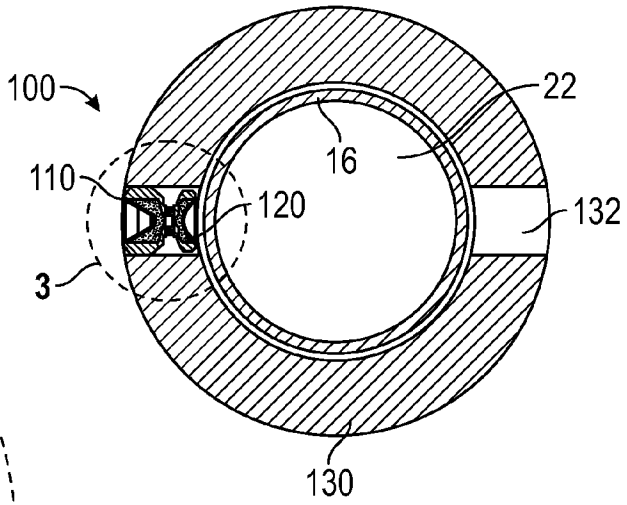
FIG. 2 illustrates a sectional view of the FIG. 1 embodiment.

Referring now to FIG. 2, there is sectionally shown one embodiment of a shaped charge assembly 100 configured to establish fluid communication between an internal bore 22 of the wellbore tubular 16 and the formation 14 (FIG. 1). The shaped charge assembly 100 may include an outwardly projecting shaped charge 110 and an inwardly projecting shaped charge 120. A sleeve-like mount 130 may include one or more bores 132 for receiving the shaped charge assembly 100. In one arrangement, the bores 132 may be transverse cavities that aim the charges 110, 120 radially into the formation 14 (FIG. 1) and casing 16, respectively. Further details of the shaped charge assembly 100 are better illustrated in FIG. 3.

Figure 3:
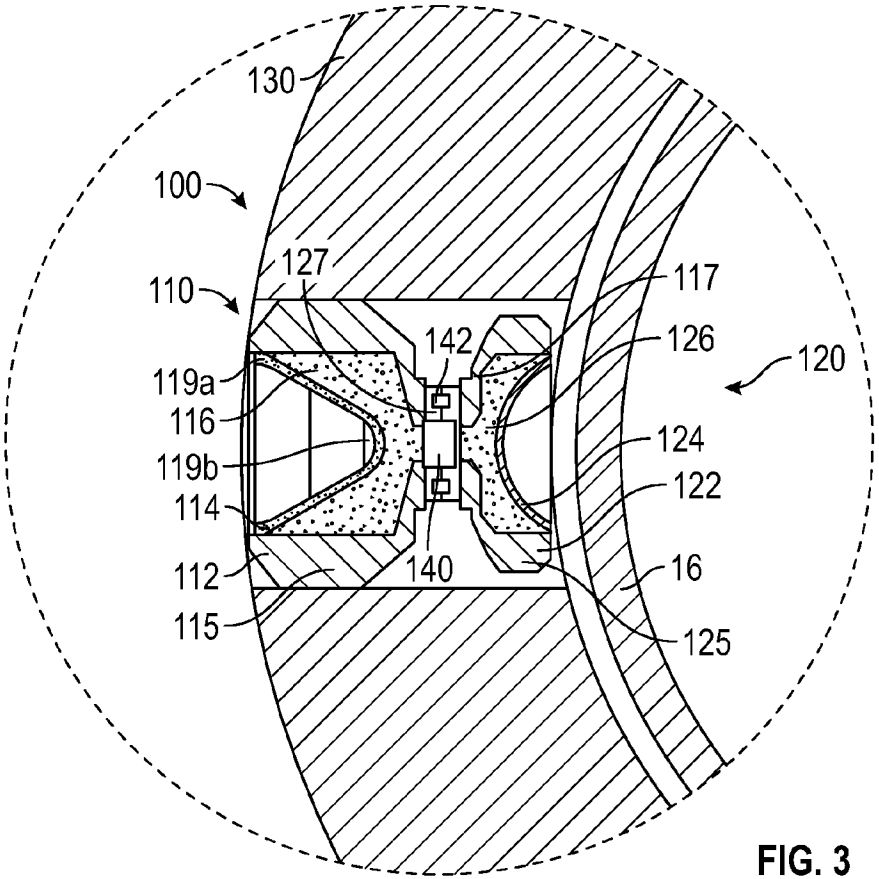
FIG. 3 illustrates an enlarged portion of the FIG. 2 embodiment.

Referring now FIG. 3, the outwardly projecting shaped charge 110 is shaped and oriented to form a tunnel in the adjacent formation 14 (FIG. 1). The shaped charge 110 may include a case 112, a liner 114, and a quantity of an explosive material 116. The charge is oriented radially outward to direct a jet formed by the liner 114 into the formation 14 (FIG. 1). In one embodiment, the case 112 has a body 115 and a post 117. The body 115 is configured to receive the liner 114 at an open mouth and the explosive material 116 in a chamber. The post 117 is formed opposite of the open mouth and may include a channel or recess to receive at least a portion of the detonator cord 140. The liner 114, which encloses the explosive material 116, has a generally conical shape. That is, the liner 114 may include a circular cup section 119*a* that tapers in a linear fashion at least along a forward section to an apex 119*b*. This conical shape is generally suited to form perforating jets that enable deep penetration and small entry holes. The shape of the case 112 may also be formed cooperatively with the liner 114 to form a deep tunnel in the formation 14 (FIG. 1). However, the shape is not limited to any particular configuration. For instance, in some embodiments, the shape may be adjusted to generate a large diameter hole or a shallow tunnel. In still other embodiments, a linear type charge may be used.

The inwardly projecting shaped charge 120 is shaped and oriented to form a puncture in the casing 16. The inwardly projecting shaped charge 120 may include a case 122, a liner 124, and a quantity of an explosive material 126. The shaped charge 120 is oriented radially inwardly to direct a shaped charge jet formed by the liner 124 into the casing 16. In one arrangement, the case 124 has a body 125 and a post 127. The body 125 is configured to receive the liner 126 at an open mouth and the explosive material 126 in a cavity. The post 127 also may include a channel or recess to receive at least a portion of the detonator cord 140. The liner 124, which encloses the explosive material 126, has a generally bowl shape, which may be considered an arcuate profile. By "bowl," it is meant that the cross-sectional shape is defined by an arc or a series of arcs. In some embodiments, the shape may be characterized as elliptical, circular, or hemispheric. This bowl shape forms a liner that is depth-wise relatively shallow, which is generally suited to create perforating jets that can puncture a casing 16. In some embodiments, the term "shallow" refers to a ratio wherein the depth of the bowl is no greater than one-half of the diameter of the bowl. The shallow configuration generally creates a jet that forms a relatively large diameter opening in one side of the casing 16 but does not have the energy to puncture the other side of the casing 16. Also, the shape of the casing 16 may be selected to cooperate with the liner 124 to form large diameter entry holes. However, the shape is not limited to any particular configuration. For instance, in some embodiments, the shape may be adjusted to generate a small diameter hole or relatively long tunnel. In still other embodiments, a linear type charge may be used.

In one embodiment, the bidirectional nature of the shaped charge assembly 100 may be achieved by radially aligning the shaped charges 110, 120. That is, the cases 112, 122 of the shaped charges 110, 120 may be aligned in opposing directions on the same radius. The term "opposing" means that the mouths of the cases 112,122 are arranged such the jets formed by the liners 114, 126 are propelled in opposing directions. In such an arrangement, the detonator cord 140 may be used to detonate the shaped charges 110, 120 at the same time. For example, as shown, the cases 112, 122 are positioned in opposing relationship to one another such that the posts 117, 127 abut to form the channel for the detonator cord 140. The cases 112 and 122 may be connected to one another using any suitable method or mechanism (e.g., mechanically, chemically, treatment such as welding, etc.). In one embodiment, connector elements 142 may be used; e.g., fasteners, posts, etc. In one arrangement, the cases 112, 122 have a geometry that is symmetric along an axis defined by a radial line extending from a center of the bore 22 (FIG. 2). The perforating jets formed by the shaped charges 110, 120 travel in opposite directions directly along this axis. The cases 112,122 may be made of materials such as steel and zinc. Other suitable materials include particle or fiber reinforced composite materials.

The explosive material 116, 126 may comprise RDX (Hexogen, Cyclotrimethylenetrinitramine), HMX (Octogen, Cyclotetramethylenetetranitramine), HNS, PYX or other suitable high explosives known in the industry for use in downhole shaped charges.

Referring still to FIG. 3, a detonator cord 140 may be used to detonate the shaped charges 110, 120. In one arrangement, the detonator cord 140 may be compressed between the posts 117, 127 of the shaped charges 110, 120 such that energy released by the detonator cord 140 is transferred to and detonates the explosive materials 116, 126. The term "energetic connection" as used herein refers to a connection that transfers the requisite energy to cause a high-order detonation of the explosive materials 116, 126. In some embodiments, a small amount of booster (not shown) may be placed between the detonator cord 140 and the explosive materials 116, 126. The booster may be formed of an explosive material that, when detonated, releases sufficient energy to cause a high-order detonation of the explosive materials, 116, 126. Referring to FIG. 1, the control system 20 may be used to detonate the detonator cord 140 using known devices such as firing heads, igniters, and fuses.

Referring now to FIGS. 1-3, during deployment, the charge assembly 100 is conveyed into the wellbore 10 using the casing 16. After being positioned at a desired depth, the casing 16 may be cemented into place. Personnel may use the control system 20 to send a firing signal. In response to the firing signal, the detonator 140 is detonated. Thereafter, the detonator 140 detonates the shaped charges 110, 120. The detonations may be simultaneous or nearly simultaneous. The detonated radially outwardly pointing shaped charge 110 forms a perforating jet that penetrates the cement 18 and forms a tunnel in the formation 14. The detonated inwardly pointing shaped charge 120 forms a perforating jet that punctures the casing 16.

From the above, it should be appreciated that what has been described includes a shaped charge assembly for perforating a wellbore tubular and a subterranean formation intersected by a wellbore. In one non-limiting embodiment, the shaped charge assembly may include a first shaped charge, a second shaped charge, and a detonator cord.

The first shaped charge may have a conically shaped liner disposed on a casing and an explosive material in a chamber formed in the casing. The casing may have a post formed opposite to the conically shaped liner. The first shaped charge may be disposed on an outer surface of the wellbore tubular and point radially outward toward the formation. The second shaped charge may have a bowl shaped liner disposed on a casing and an explosive material in a chamber formed in the casing. The casing may also have a post formed opposite to the bowl shaped liner. The second shaped charge may be disposed on the outer surface of the wellbore tubular and point radially inward toward the wellbore tubular. The post of the first shaped charge may be connected with the post of the second shaped charge. The detonator cord may be compressed between the posts of the first and the second shaped charges. The detonator cord may be energetically connected to the explosive charges of the first and the second shaped charges. The detonation of the explosive charges may form perforating jets that travel in substantially opposite directions.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

The invention claimed is:

1. A shaped charge assembly for perforating a wellbore tubular and a subterranean formation intersected by a wellbore, comprising:

a first shaped charge having a casing, a conically shaped liner disposed on the casing, and an explosive material in a chamber formed in the casing, the casing having a post formed opposite to the conically shaped liner, the post of the first shaped charge casing having a channel, the first shaped charge being disposed on an outer surface of the wellbore tubular and pointing radially outward toward the formation;

a second shaped charge having a casing, a bowl shaped liner disposed on the casing, and an explosive material in a chamber formed in the casing, the casing having a post formed opposite to the bowl shaped liner, the post of the second shaped charge casing having a channel, the second shaped charge pointing radially inward toward the wellbore tubular, the post of the first shaped charge abutting the post of the second shaped charge; and a detonator cord compressed between the posts of the first and the second shaped charges, the detonator cord having a first portion in the channel of the post of the first shaped charge casing and a second portion in the channel of the post of the second shaped charge casing, the detonator cord being energetically connected to the explosive charges of the first and the second shaped charges, and wherein detonation of the explosive charges forms perforating jets that travel in substantially opposite directions.

2. The shaped charge assembly of claim 1, wherein the bowl shaped liner has a shape representative of: (i) a circle, and (ii) an ellipse.

3. The shaped charge assembly of claim 1, further comprising a booster disposed between the detonator cord and the explosive materials.

4. The shaped charge assembly of claim 1, further comprising connector elements attaching the post of the first shaped charge to the post of the second shaped charge.

5. The shaped charge assembly of claim 1, wherein the shaped charged assembly is configured to be positioned in a bore of a sleeve, the bore aligned along a axis transverse to a bore of the wellbore tubular.

6. A shaped charge assembly located in a bore of a mount, the bore having an axis transverse to a bore of a wellbore tubular, comprising:

a first shaped charge having a casing, a conically shaped liner disposed on the casing, and an explosive material in a chamber formed in the casing, the casing having a post formed opposite to the conically shaped liner, the first shaped charge being inside the bore of the mount and pointing radially along the axis of the bore that is transverse to the bore of the wellbore tubular;

a second shaped charge having a casing, a bowl shaped liner disposed on the casing, and an explosive material in a chamber formed in the casing, the casing having a post formed opposite to the bowl shaped liner, the second shaped charge being inside the bore of the mount and pointing radially inward toward the wellbore tubular and along the bore of the mount and pointing radially along the axis of the bore that is transverse to the bore of the wellbore tubular, the post of the first shaped charge abutting the post of the second shaped charge; and a detonator cord compressed between the posts of the first and the second shaped charges, the detonator cord being energetically connected to the explosive charges of the first and the second shaped charges, and wherein detonation of the explosive charges forms perforating jets that travel in substantially opposite directions.

7. The shaped charge assembly of claim 6, wherein the bowl shaped liner has a shape representative of: (i) a circle, and (ii) an ellipse.

8. The shaped charge assembly of claim 6, further comprising a booster disposed between the detonator cord and the explosive materials.

* * * * *